US006622868B1

(12) United States Patent
McDonald

(10) Patent No.: US 6,622,868 B1
(45) Date of Patent: Sep. 23, 2003

(54) SYSTEM FOR RECOVERING AND RECYCLING USABLE FIBERS FROM WHITE WATER IN A PAPERMAKING PROCESS

(75) Inventor: Joseph P. McDonald, Appleton, WI (US)

(73) Assignee: Whitewater Solutions Corp., Appleton, WI (US)

( * ) Notice: Subject to any disclaimer, the term of this patent is extended or adjusted under 35 U.S.C. 154(b) by 0 days.

(21) Appl. No.: 10/194,785

(22) Filed: Jul. 12, 2002

(51) Int. Cl.[7] ..... B07B 1/24

(52) U.S. Cl. ..... 209/254; 209/252; 209/268; 209/270

(58) Field of Search ..... 209/268, 270, 209/273, 254

(56) References Cited

U.S. PATENT DOCUMENTS

| | | | | | |
|---|---|---|---|---|---|
| 1,897,156 | A | * | 2/1933 | Wells | 209/270 |
| 2,983,378 | A | * | 5/1961 | Hilkemeier | 209/270 |
| 3,081,873 | A | * | 3/1963 | Cowan et al. | 209/273 |
| 3,220,546 | A | | 11/1965 | Gardner | |
| 3,501,002 | A | | 3/1970 | Talley, Jr. | |
| 3,637,077 | A | * | 1/1972 | Cowan | 209/273 |

(List continued on next page.)

OTHER PUBLICATIONS

"Screen Reinvented", Kroosh Technologies, www.kroosh-.com, Mar. 20, 2002.

"The Original Gravity Strainer", Strain–EL HyXoOy, Pulp & Paper Technology, Inc., 3250 Peachtree Industrial Blvd., Suite 110, Duluth, GA 30096–8310, undated.

"Reference List—Tissue Applications", Poseidon, Inc., 810, Champagneur, Suite 215, Outremont, Quebec, Canada H2V 4S3, Sep. 26, 2000.

"AES Fiber Retriever", Bulletin STR–1000, Feb. 96, AES Engineered Systems, Queensbury, NY 12804.

"Para–Flow Inclined Screen", PF300R2M, 2000, AES Engineered Systems, Queensbury, NY 12804.

Recycle/Reuse Water With The PETAX Fine Filtration System, 2001, AES Engineered Systems, Queensbury, NY 12804.

*Primary Examiner*—Donald P. Walsh
*Assistant Examiner*—Jonathan R Miller
(74) *Attorney, Agent, or Firm*—Boyle, Fredrickson, Newholm, Stein & Gratz, S.C.

(57) ABSTRACT

A system for recovering and recirculating usable fibers contained in papermaking white water. The system employs a flexible and pliable screen to which the papermaking white water is applied. The screen is supported in a suspended manner from a frame. The white water is directed onto an inside surface defined by the screen, and the location at which the white water strikes the screen is varied so as to result in bending and flexing of the screen. In this manner, the screen openings are self-cleaned, to prevent the screen from plugging due to material contained in the white water. In one form, the screen is generally frustoconical, and the white water is applied to the inside surface of the screen in a manner which results in rotation of the screen. The usable fibers are directed toward a discharge opening defined by the lower end of the frustoconical screen, and the waste water passes through the screen and is collected in a waste water collection tank. The fibers are collected in a fiber collection tank, and are recirculated into the papermaking process. In another form, the screen is suspended from a frame to form a trough configuration having an open discharge end. The frame is movable in either an axial direction or a transverse direction, to cause movement of the screen and to obtain the desired flexing and bending of the screen to self-clean the screen openings.

13 Claims, 12 Drawing Sheets

U.S. PATENT DOCUMENTS 3,692,183 A * 9/1972 Tra ..... 210/415
3,720,316 A 3/1973 Riesbeck et al.
4,374,728 A * 2/1983 Gauld ..... 209/273
4,613,432 A 9/1986 Racine et al.
4,697,982 A * 10/1987 Hooper ..... 415/121.2
5,051,171 A 9/1991 Hukki
5,152,891 A * 10/1992 Netkowicz et al. ..... 210/408
5,182,008 A * 1/1993 Shelstad ..... 210/139
5,224,603 A * 7/1993 Hanana et al. ..... 209/270
5,259,955 A * 11/1993 Bolton ..... 408/30
5,431,287 A 7/1995 Knox
5,771,718 A * 6/1998 Ide et al. ..... 68/142
5,839,142 A * 11/1998 Bolton ..... 416/113
5,992,641 A 11/1999 Caldwell, Jr.
6,010,012 A * 1/2000 Gero ..... 209/306

* cited by examiner

SYSTEM FOR RECOVERING AND RECYCLING USABLE FIBERS FROM WHITE WATER IN A PAPERMAKING PROCESS

BACKGROUND AND SUMMARY OF THE INVENTION

This invention relates to a process for making products such as paper or tissue from pulp or other fiber-containing material, and more particularly to a process for recovering and recirculating usable fibers contained in water produced in such a process.

The manufacture of products such as paper and tissue uses fibrous material such as wood pulp, which is processed in a known manner to produce the desired end product. In a paper or tissue making process, the pulp is applied to a screen or papermaking fabric from a headbox, and water is pressed out of the pulp in a known manner to form the paper or tissue, which is dried and formed into a roll. The water that is pressed out of the pulp is commonly known as white water, and typically includes small particles of fines and ash material which pass through the fabric along with the water. In addition, the white water inevitably includes a quantity of usable fibers that pass through the papermaking fabric, which are wasted if the white water is discarded. This is a recognized problem in the tissue industry, and has resulted in the development of systems that recirculate the white water back into the pulp supply system, to recirculate the usable fibers. However, such systems also recirculate the fines and ash material. This is acceptable in a papermaking process, in which the fines and ash material can be incorporated into the paper. However, the presence of such material is very detrimental in a tissue making process, in that the small particles of material inhibit drainage. Accordingly, simple recirculation systems are undesirable in a tissue making process, since the undesirable fines and ash are simply continuously recirculated in the process. Certain screen systems, which employ a stationary screen, have been developed in an effort so separate the usable fibers from the fines and ash. Typically, fibers retained on the screen are intermittently doctored off the screen and recirculated in the pulp supply system. Because such systems necessarily use screens with small openings, there is a significant tendency for the screen openings to plug or "blind over" due to the buildup of material in the openings. Accordingly, many known systems either do not function properly for this reason, or require a great deal of maintenance to keep the screen openings from plugging.

It is an object of the present invention to provide an effective system for recovering usable fibers from white water in a papermaking system, in order to enable usable fibers to be recirculated into the system without recirculating the undesirable unusable material such as fines and ash commonly found in papermaking white water. It is another object of the invention to provide such as a system which involves little modification to an existing papermaking circulation system, while enabling recovery of usable fibers from white water and recirculating the usable fibers for use. It is a further object of the invention to provide such a system which requires little maintenance and which is relatively simple in its components, construction and operation, to enable the system to be installed and operated at a relatively low cost so as to justify recovery and recirculation of usable fibers from the white water. It is a further object of the invention to replace ineffective existing recovery systems with a recovery system that provides a clean supply of material to the forming fabric to enable more efficient operation of the system.

In accordance with the present invention, a fiber recovery system for a tissue or papermaking process utilizes a filter or screen, onto which white water from the process is directed at a location downstream of a white water collection vessel forming a part of the papermaking system. The screen is sized so as to allow water containing the undesirable or unusable components of the white water, such as fines and ash, to pass through the screen while retaining usable fibers on the screen. The water containing the undesirable or unusable material is routed to a wastewater treatment facility, in a conventional manner, and the cleaned water can then be resupplied to the system. The screen, onto which the white water is directed, may be formed of a flexible and pliable screening material, which may be the same type of material as is commonly employed as the fabric in a tissue or papermaking system. The screen is supported in a manner such that the screen is maintained relatively loose and flexible, e.g. by suspending the screen from a frame. The screen is subjected to motion as the white water is directed onto the screen, which results in a self-cleaning action of the screen so as to prevent plugging and blinding of the screen openings. The invention contemplates several different arrangements for supporting and imparting motion to the screen, and for directing the white water onto the screen. In all versions, the white water is applied to an interior area defined by the screen, and the usable fibers are collected on the inner surface of the screen. The screen is configured to direct the usable fibers to an open discharge area, where the usable fibers are discharged from the screen. The usable fibers are then returned to the system and incorporated into the fibrous material supplied to the headbox, for subsequent application to the tissue or papermaking fabric.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
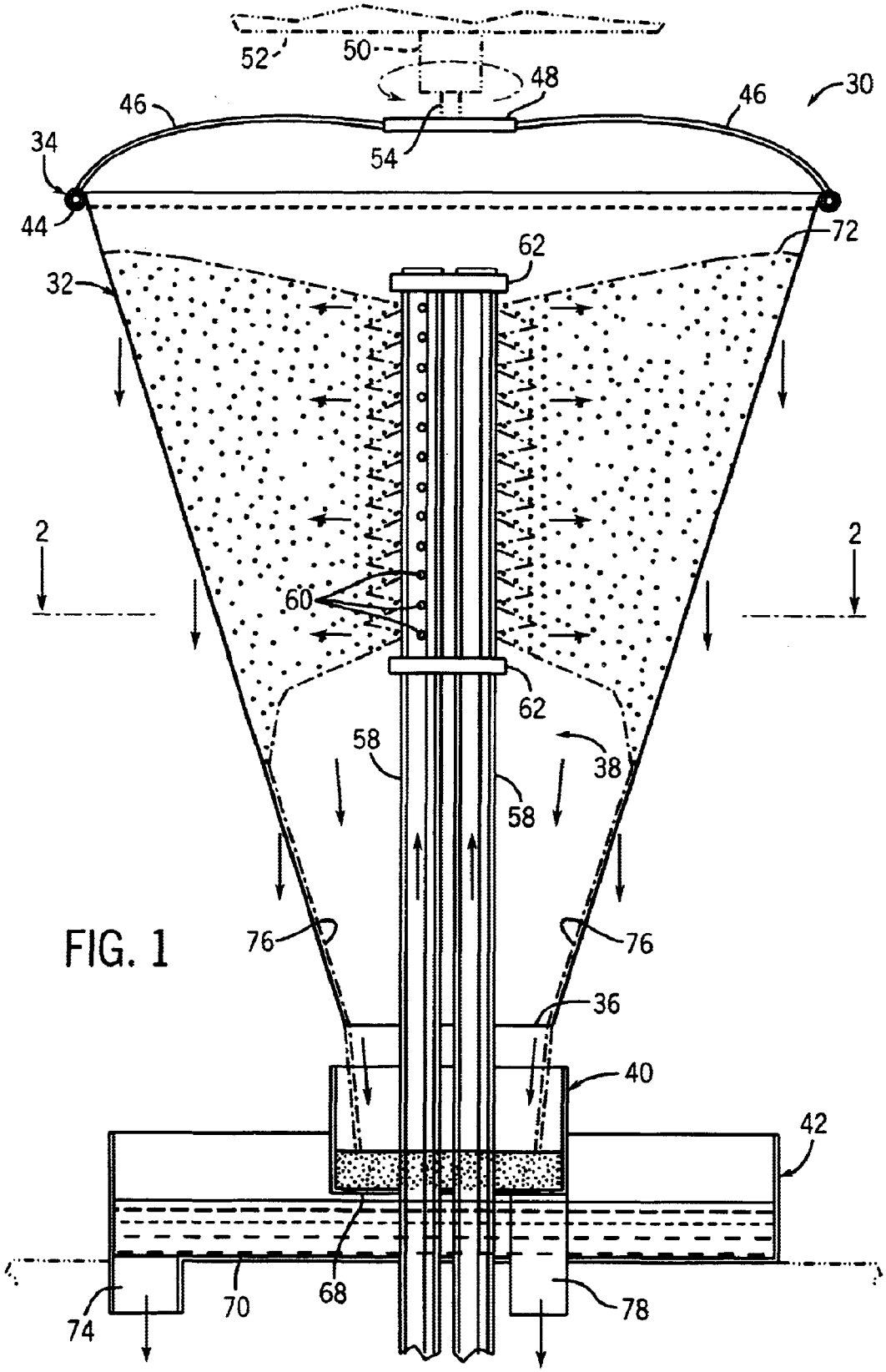
FIG. 1 is a side elevation view, partially in section, showing one embodiment of a fiber recovery system in accordance with the present invention.
Figure 2:
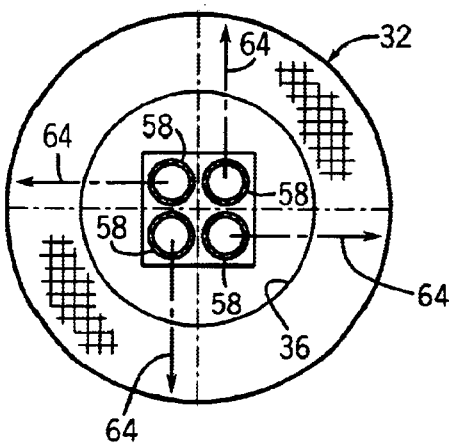
FIG. 2 is a partial section view taken along line 2—2 of FIG. 1, showing the screen at rest.
Figure 3:
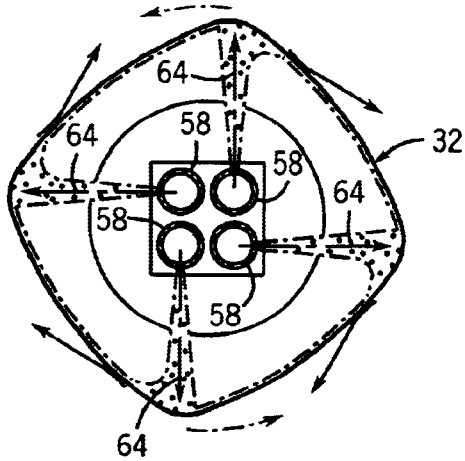
FIG. 3 is a view similar to FIG. 2, showing operation of the system and rotational movement of the screen.

FIGS. 1–3 illustrate a first embodiment of a fiber recovery system, shown generally at 30, in accordance with the present invention, which is particularly well suited for use in a tissue making process. Generally, fiber recovery system 30 includes a screen 32 suspended from a frame 34 and configured to define a discharge opening 36, in combination with a white water supply system 38 which is operable to direct white water from a papermaking system onto a surface of screen 32. Fiber recovery system 30 also includes an upwardly open fiber collection vessel or tank 40 located below discharge opening 36 of screen 32, and an upwardly open waste water collection vessel or tank 42.

Screen 32 is formed of a flexible and pliable screening material, and is frustoconical in shape. The material of screen 32 may be of the same type that is used as the fabric in a tissue making process. Representatively, the material of screen 32 is a screen material such as is available from Albany International, Appleton, Wire Division, Appleton, Wisconsin under Model No. M-Weave, Duraform, Z-76, which is a five shed tissue making screen material having a strand count of 84/in. (M.D.), 78/in. (C.D.), a permeability of 730 CFM and a caliper of 0.016 inches. It is understood that this type of screen material is representative of various types of screen material that may be employed, depending upon the size of fibers to be collected as well as various other operating parameters. The function of the flexibility and pliability of screen 32 will later be explained.

The upper end of screen 32 is secured to frame 34, so that screen 32 is suspended from frame 34. Frame 34 includes an outer peripheral frame member 44, which is generally circular, and to which the upper end of screen 32 is connected. Frame 34 further includes a series of radial spokes 46 that extend between outer frame member 44 and a hub 48. A mounting member 50 is secured to any satisfactory upper support member 52, and includes a rotatable shaft 54 to which hub 48 is connected. In this manner, frame 34 and screen 32 are rotatable about a longitudinal axis of rotation defined by the longitudinal axis of screen 32, which is coincident with the longitudinal axis of shaft 54.

Screen 32 is configured such that its sides define an included angle of approximately 35°. Representatively, screen 32 defines an upper diameter of 80 inches, where screen 32 is connected to outer frame member 44, and discharge opening 36 has a diameter of 12 inches. The height of screen 32 is approximately 84 inches. It is understood that these dimensions and angles are provided to illustrate one embodiment of screen 32 and frame 34 which have been found to provide satisfactory results, and that other dimensions and angles may also be found to function satisfactorily.

White water supply system 38 is operable to direct white water from a papermaking process onto the inside surface of screen 32. As shown in FIGS. 1–3, white water supply system 38 is in the form of a series of upwardly extending conduits 58, which are centered on a longitudinal axis coincident with the longitudinal axis of screen 32. Each conduit 58 is provided with a series of spaced openings 60 along its length, and is closed at its upper end. Representatively, each conduit 58 has an inside diameter of 3.0 inches, although it is understood that any other satisfactory conduit size may be employed. Conduits 58 extend through brackets 62, which function to maintain the position of conduits 58 relative to each other. Openings 60 in each conduit 58 are arranged in a linear fashion. The line of openings 60 in each conduit 58 is radially oriented so as to face in a direction perpendicular to the facing direction of the line of openings 60 in the adjacent conduit 58. As shown in FIG. 2, each line of openings 60 is oriented so as to face in a direction parallel to and laterally offset from a radius of screen 32. In this manner, each line of openings 60 functions to direct white water onto the inner surface of screen 32 in a direction generally indicated by an arrow 64 (FIG. 2), so that white water impinging on the inner surface of screen 32 applies both a radial force and a tangential force to the inside surface of screen 32. Representatively, each opening 60 is circular in shape, and has a diameter of approximately 0.375 inches, although it is understood that any other shape and transverse dimension may be employed.

Conduits 58 extend through a bottom wall 68 defined by fiber collection tank 40, and through a bottom wall 70 defined by waste water collection tank 42. Openings are formed in tank bottom walls 68 and 70 to accommodate passage of conduits 58 therethrough, and appropriate fluid-tight seals are provided between conduits 58 and tank bottom walls 68, 70. Alternatively, conduits 58 may be routed laterally outwardly between discharge opening 36 and fiber collection tank 40, to avoid the difficulties and maintenance associated with sealing between conduits 58 and walls 68, 70.

In operation, fiber recovery system 30 functions as follows to recover usable fibers from papermaking white water, which is supplied through conduits 58. The white water is directed toward the inside surfaces of screen 32 by emission through openings 60 of conduits 58. Each line of openings 60 forms a series of linear white water shower streams, so that white water is applied to the inside surfaces of screen 32 generally in a pattern shown at 72. The tangential component of the force with which each shower of white water strikes the inside surface of screen 32 functions to impart rotation to screen 32 about its longitudinal axis, by rotation of shaft 54 relative to mounting member 50. The speed of rotation of screen 32 is dependent upon the amount of force applied by each shower of white water, which is proportional to the pressure of the white water in conduits 58, as well as the angle of the white water shower streams. Representatively, it has been found that satisfactory operation is obtained by maintaining a low pressure of (e.g. 5 psi) in conduits 58 functions to apply a force to screen 32 which causes screen 32 to rotate at a speed of approximately 40 rpm.

The openings of screen 32 are sized to retain usable fibers on the inside surface of screen 32, and to allow water and waste material contained within the white water, such as fines and ash, to pass through the openings of screen 32. The waste water passes through screen 32 to the exterior of screen 32, and falls by gravity into waste water collection tank 42. The waste water may also travel down the outside surfaces of screen 32. If desired, a shirt is provided at the lower end of screen 32 so as to direct the waste water outwardly into waste water collection tank 42. The waste water is then routed through a waste water outlet 74 of waste water collection tank 42 to a waste water treatment system, where the solids are removed and the cleaned water can be recirculated into the papermaking process.

The usable fibers contained within the white water, which are retained on the inside surface of screen 32, travel downwardly on the inside surface of screen 32 toward discharge opening 36, by gravity. The layer of usable fibers collected on the inside surface of screen 32 is representatively illustrated at 76. As the usable fiber layer 76 travels downwardly on the inside surface of screen 32, the centrifugal forces due to rotation of screen 32 function to expel additional water and waste material through the openings of screen 32 as the usable fibers advance toward discharge opening 36. In this manner, the usable fibers that are discharged through discharge opening 36 are of a relatively thick consistency, having most of the waste water expelled therefrom. The usable fibers are collected in fiber collection tank 40, and are routed through a fiber discharge outlet 78 of collection tank 40 to a pump, which recirculates the usable fibers into the papermaking process. Alternatively, fiber recovery system 30 may be installed above chest level, such that gravity flow is employed in place of a pumping operation to recirculate the usable fibers.

Figure 4:
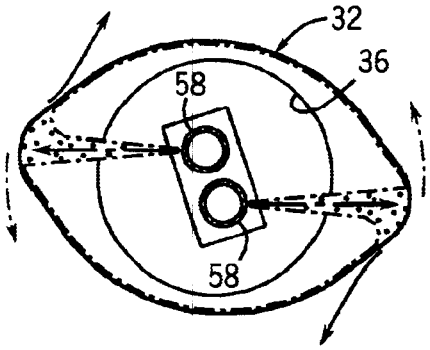
FIGS. 4 and 5 are views similar to FIG. 3, showing alternative arrangements for directing the white water onto the screen.
Figure 5:
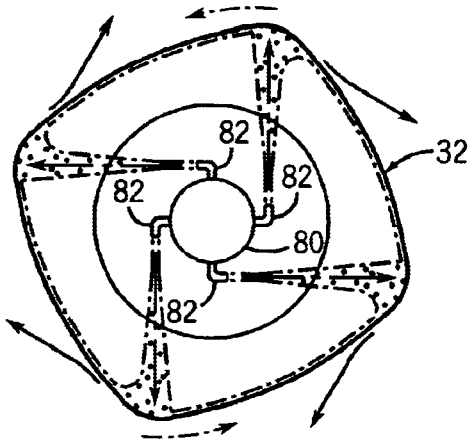

The white water may be applied to screen 32 in various other ways, and examples are illustrated in FIGS. 4 and 5. As shown in FIG. 4, two supply conduits 58 may be employed to apply the white water to screen 32 in place of the four conduits 58 as illustrated in FIGS. 2 and 3. Again, the openings 60 in conduits 58 are arranged so as to be offset relative to the center of screen 32 and relative to radii of screen 32, to apply the showers to screen 32 with a tangential force to impart rotation to screen 32. FIG. 5 illustrates another embodiment, in which white water is supplied through a single conduit 80, with a series of elbows 82 that provide the radial offset of the shower to apply a tangential force to screen 32 so as to impart rotation to screen 32.

While FIGS. 1–5 illustrate a certain embodiment of the invention, it is understood that variations to this version are possible and contemplated as being within the scope of the present invention. For example, and without limitation, it is contemplated that rotation to screen 32 may be accomplished by use of a motor, to ensure that screen 32 rotates at a desired speed. In a version such as this, the white water showers are preferably applied to the screen in a radial manner, to thereby eliminate the tangential component of the force applied by the shower. Further, while screen 32 has been illustrated as having a straight-sided frustoconical configuration, it is also considered that the sides of screen 32 may have a convex or concave configuration if desired. The white water may also be applied to the inside surface of the screen in any location and in any manner, and the illustrated embodiments are understood to simply be representative of a variety of ways by which the white water may be applied. While the drawings illustrate the use of four showers to apply white water to the screen, it is understood that any desired number and size of showers may be employed.

The flexibility of screen 32 enables screen 32 to deform from its normal shape during operation as white water is directed onto and strikes screen 32. As shown in FIG. 3, the four showers applied to screen 32 function to deflect the portions of the screen outwardly where the white water showers are applied, to provide generally convex arcuate side areas between the outwardly deformed areas. This flexibility and pliability of the screen material provides a "self-cleaning" action of the screen, in that the individual strands of screen material flex and bend to prevent the build-up of material in the corners of the screen openings, which can result in plugging of the screen openings and "blinding" of the screen. Fiber recovery system 30 thus requires very little maintenance, while providing an extremely effective and efficient system for collecting usable fibers and separating out unusable material.

Figure 6:
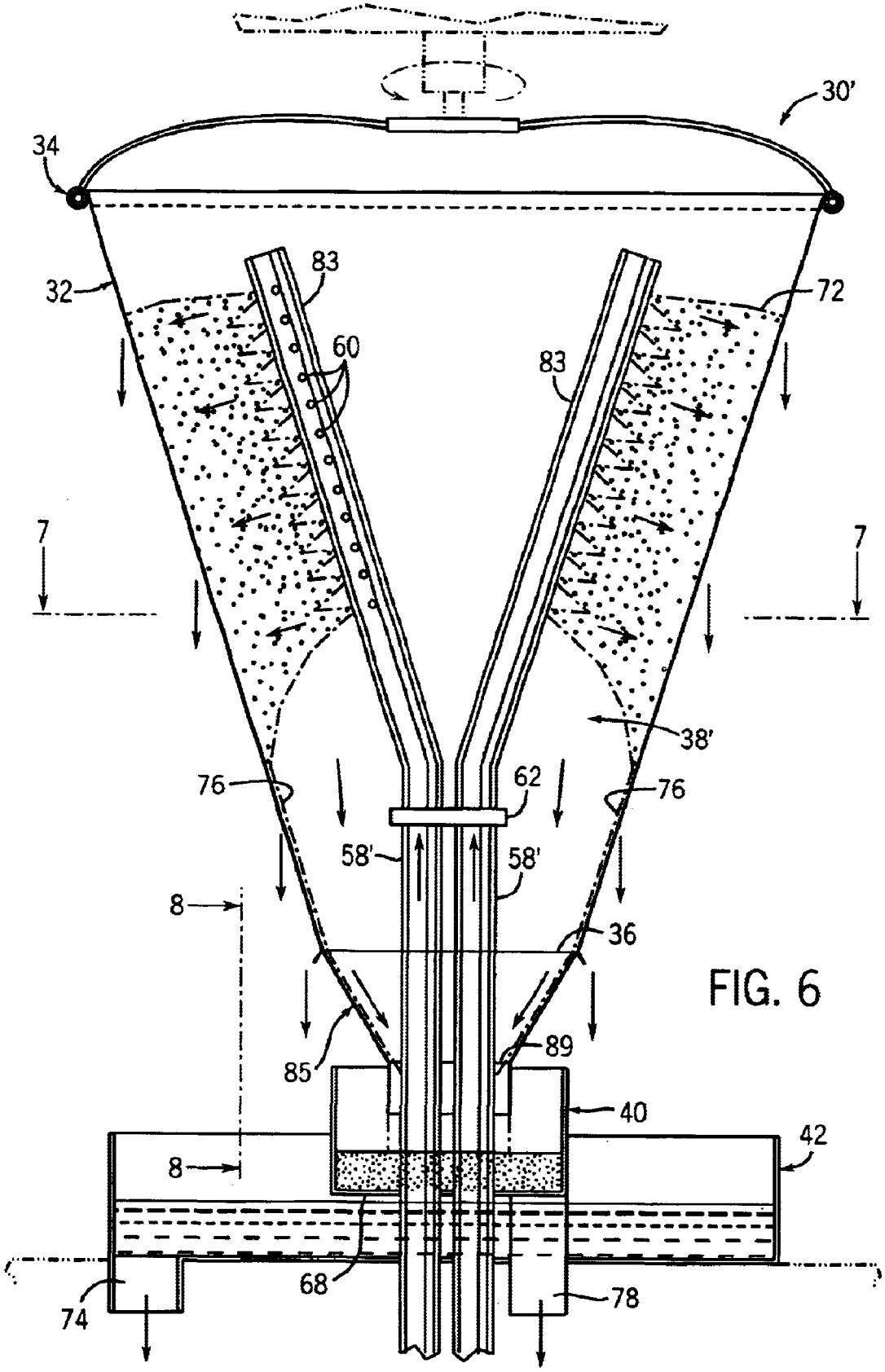
FIG. 6 is a view similar to FIG. 1, showing an alternative embodiment of the fiber recovery system of the present invention.
Figure 7:
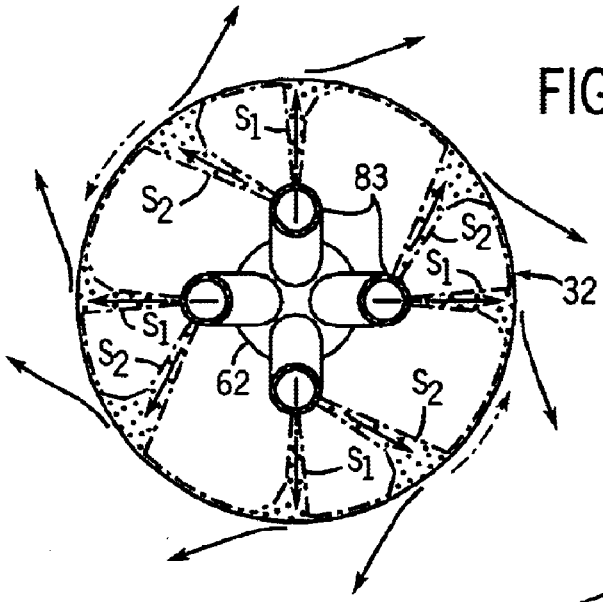
FIG. 7 is a section view taken along line 7—7 of FIG. 6.
Figure 8:
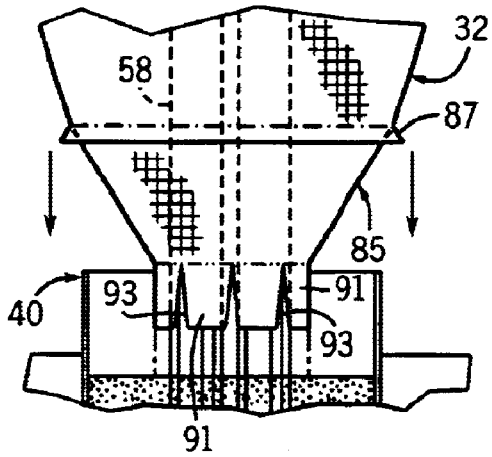
FIG. 8 is a partial side elevation view of the lower end of the screen incorporated in the fiber recovery system illustrated in FIG. 6, with reference to line 8—8 of FIG. 6.

FIGS. 6–8 illustrate an alternative embodiment of a fiber recovery system, shown generally at 30', which is generally similar to fiber recovery system 30 as illustrated and described previously. Like reference characters will be used where possible to facilitate clarity.

In fiber recovery system 30', screen 32 is suspended from frame 34 and has the same general configuration as described previously. In fiber recovery system 30', the white water supply system, shown generally at 38', differs somewhat from white water supply system 38 in that each conduit 58' includes a lower section located below bracket 62, and an upper section 83 which is angled outwardly relative to the lower section. Upper sections 83 of conduits 58' diverge in an upward direction, and each upper section 83 is oriented substantially parallel to the side of screen 32 so that the streams of white water discharged from openings 60 are applied in a substantially perpendicular direction to screen 32. This orientation of conduit upper sections 83 functions to provide a more efficient and direct application of white water to the inside surface of screen 32.

Referring to FIG. 7, each conduit upper section 83 has two lines of openings 60. One of the lines of openings 60 is oriented so as to apply a line of white water streams $S_1$ which is directed outwardly in a radial direction relative to the center of screen 32. Each conduit upper section 83 further includes an additional line of openings 60 that is angled relative to the radially facing line of openings 60. The second line of openings is positioned so as to emit a series of streams $S_2$. Each stream $S_2$ is oriented at an angle of approximately 45° relative to the streams $S_1$, and each stream $S_2$ strikes the inside surface of screen 32 so as to apply a force having both a radial and a tangential component to the inside surface of screen 32. Streams $S_2$ thus function to impart rotation to screen 32 due to the presence of the tangential force component. In addition, the emission of two separate streams from each conduit upper section 83 functions to apply white water throughout a significant portion of the interior surface of screen 32, to maximize the surface area of screen 32 to which white water is applied.

As shown in FIGS. 6 and 8, a lower section 85 is secured to the bottom end of screen 32 at discharge opening 36. Lower section 85 is secured to screen 32 via a skirt 87. Lower section 85 functions to increase the overall screen surface area, and routes usable fiber material inwardly to an outlet 89 at its lower end, which surrounds conduits 58'. At outlet 89, lower section 85 may include a series of flaps 91 separated by slits 93. Usable fibers are discharged into fiber collection tank 38 through slits 93. In operation, fibers are collected on the inside surface of lower section 85, and skirt 87 functions to route waste water outwardly beyond the walls of fiber collection tank 40, to prevent waste water from falling into fiber collection tank 40.

Figure 9:
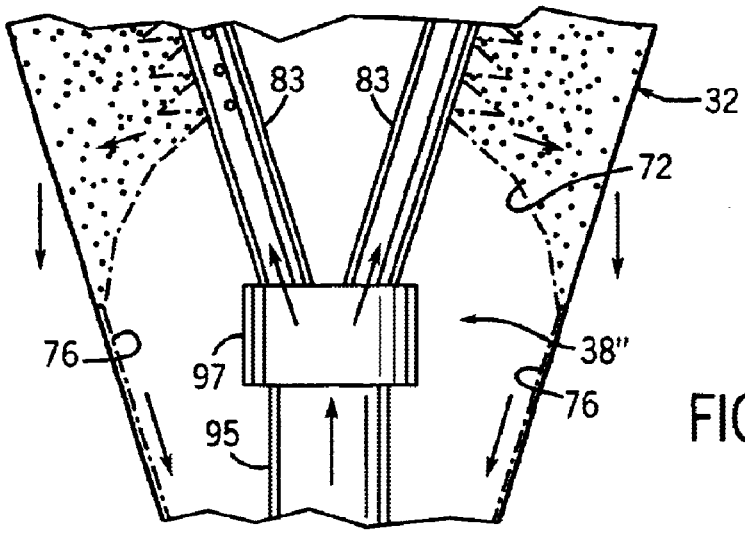
FIG. 9 is an enlarged partial section view illustrating an alternative white water supply arrangement for the fiber recovery system illustrated in FIG. 6.

FIG. 9 illustrates an alternative white water supply system 38", which includes angled upper conduit sections 83 as shown in FIGS. 6 and 7. In this embodiment, white water supply system 38" includes a single supply conduit 95 which extends upwardly into the lower area of screen 32, and supplies white water to a manifold 97 secured to the upper end of conduit 95. Angled upper conduit sections 83 are in turn connected to manifold 97, and receive white water from manifold 97 for application through openings 60 to the inside surface of screen 32 in the manner as described previously. In this embodiment, a single pipe is required to supply white water to the recovery system as opposed to the multiple pipes illustrated in the prior embodiments. With this construction, funnel section 85 can be sized such that its discharge 89 conforms relatively closely to the exterior surface of conduit 95, to further provide additional control for the discharge of usable fibers from funnel section 85.

FIGS. 10, 11, 12A and 12B illustrate an alternative fiber recovery system in accordance with the present invention, shown generally at 84. In this embodiment, a screen 86 is suspended from a frame 88 having an open discharge end 90. A white water supply conduit 92 directs papermaking white water onto screen 86. A fiber collection tank 94 is located below discharge end 90 of screen 86, and a waste water collection tank 96 is located below the remainder of the length of screen 86.

Frame 88 is generally rectangular in plan, and includes a pair of end frame members 98 and a pair of side frame members 100. Screen 86 is formed of the same type of material as screen 32. Screen 86 has a channel or trough configuration,. defining a closed end 102, and a pair of sloped side walls 104 that converge at a trough bottom 106. Screen 86 is oriented such that trough bottom 106 slopes downwardly in a direction toward discharge end 90.

White water supply conduit 92 defines an outlet 108 which directs white water onto the inside surface of screen 86 in the direction of an arrow shown at 110. Outlet 108 of conduit 92 is located toward the discharge end of screen 86, and the pressure of white water within conduit 92 is such that, upon discharge from outlet 108, the white water strikes the inside surfaces of screen 86 at its side wall 104 in close proximity to closed end 102, and is deflected onto closed end 102 and bottom 106.

Figure 12A:
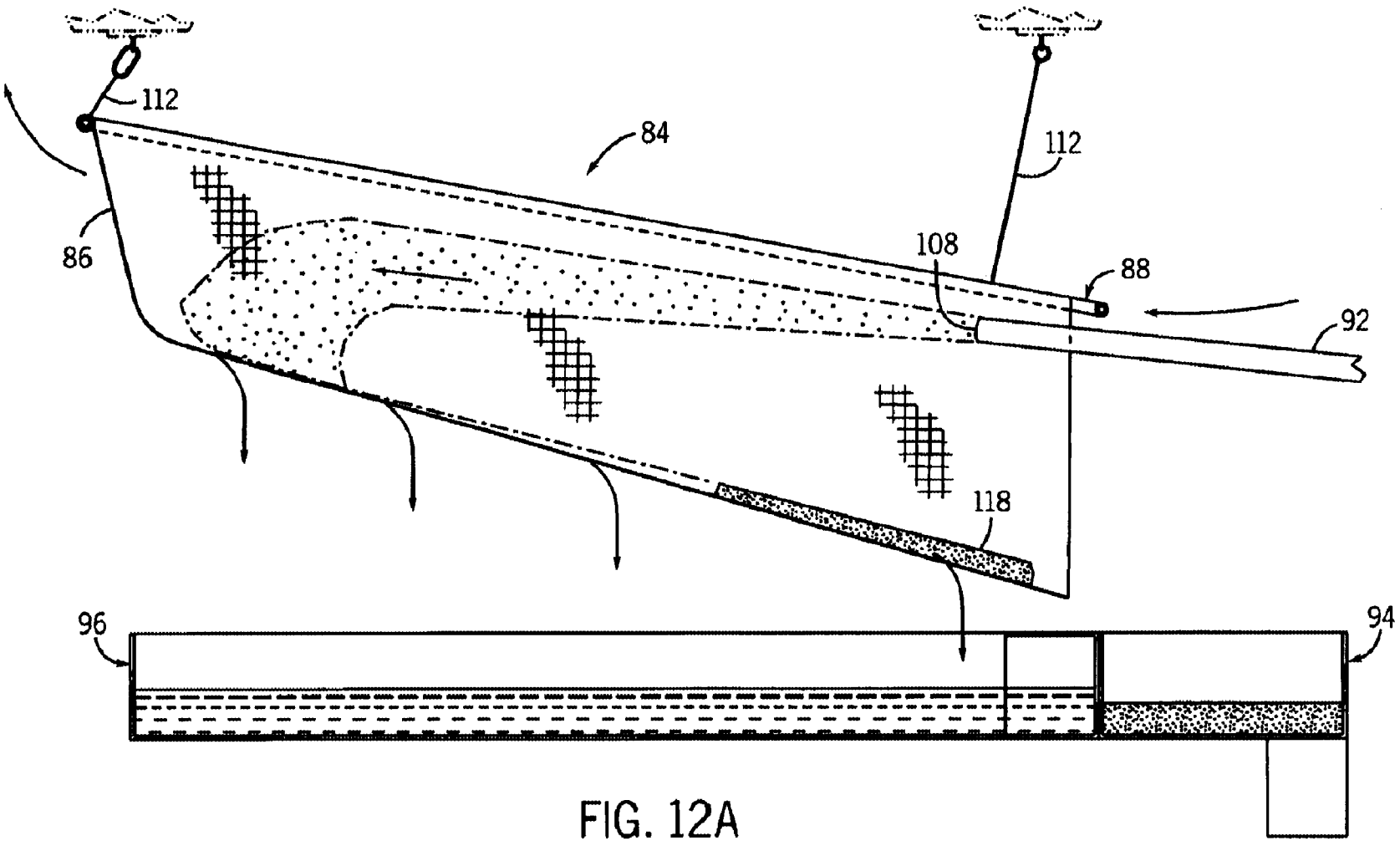
FIGS. 12A and 12B are views similar to FIG. 11, showing the screen being subjected to motion for cleaning of the screen and for discharging collected fibers from the discharge area of the screen.
Figure 12B:
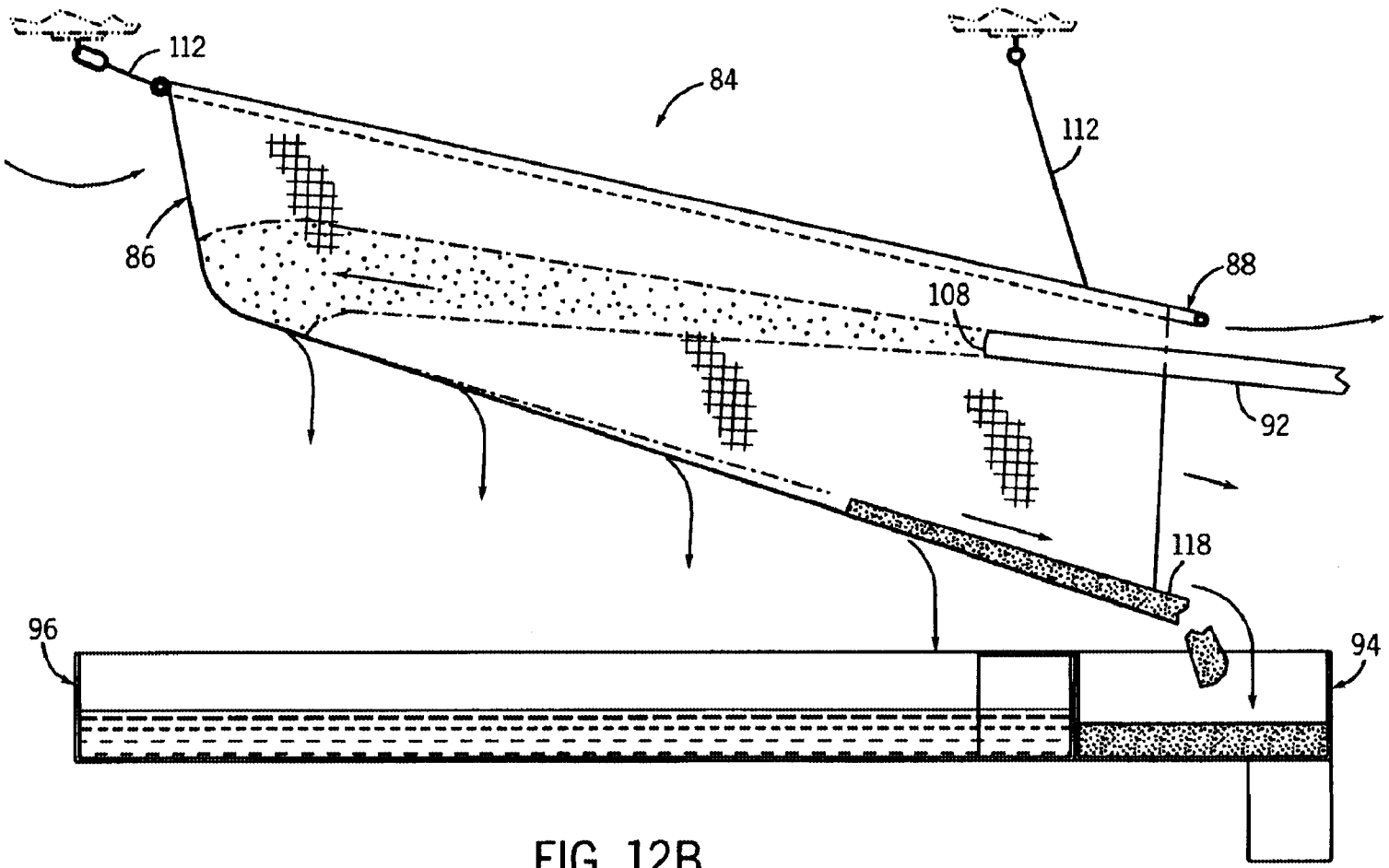

Frame 88 is supported in a manner which allows frame 88 and screen 86 to be movable. In the illustrated embodiment, frame 88 is supported in a suspension-type manner using cables 112 and rings 114, which in turn are connected to suitable upper supports 116. As shown in FIGS. 12A and 12B, frame 88 and screen 86 are adapted to be moved in a longitudinal, axial direction in a back and forth manner, while white water is applied to the inside surfaces of screen 86 through conduit 92.

Figure 11:
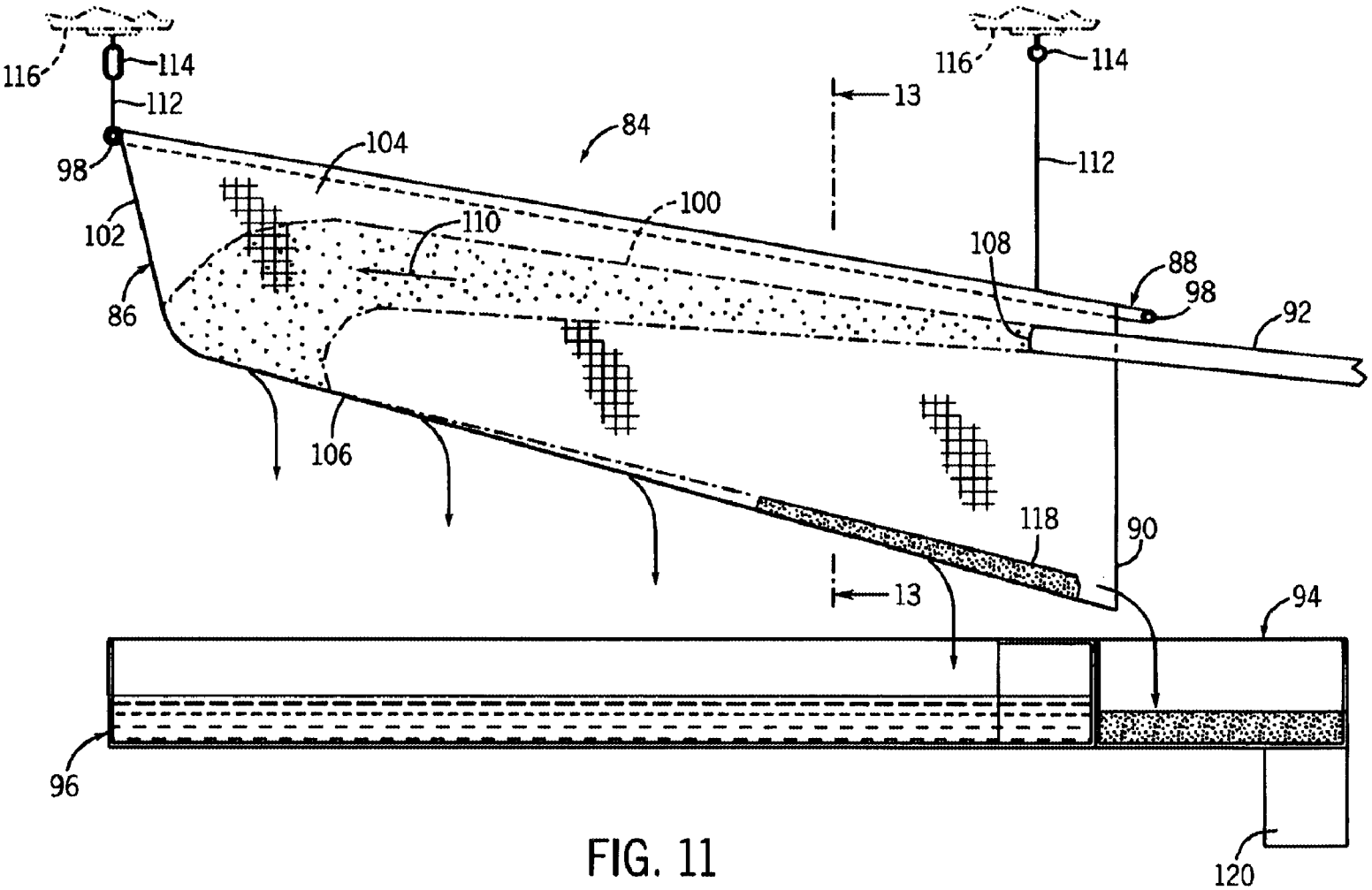
FIG. 11 is a section view taken along line 11—11 of FIG. 10.

In operation, tissue or papermaking white water is applied to the inside surfaces of screen 86 as shown in FIG. 11, through outlet 108 of conduit 92. Again, the openings of screen 86 are sized to retain usable material contained within the white water on the inside surfaces of screen 86. The waste water, including the unusable material such as fines and ash, passes through screen 86 and is collected in waste water collection tank 96. Either intermittently or continuously, screen 86 is moved in a back and forth, axial manner while white water continues to be applied to the inside surfaces of screen 86. The back and forth movement of screen 86 is carried out in any satisfactory manner, preferably in an automated manner by operation of a motor with an intermittent driver, such as a cam-type actuator or the like. To accomplish this, frame 96 is pushed rearwardly to a position as shown in FIG. 12A, and is then allowed to swing forwardly under its own weight, which includes the weight of frame 88, screen 86, and the material retained on screen 86. This movement of screen 86 accomplishes numerous functions. First, the usable fibers, which are collected in the trough of screen 86 on screen bottom 106 and the lower areas of side walls 104, are advanced forwardly toward discharge openings 90 when screen 86 is swung forwardly as shown in FIG. 12B. This causes the endmost portion of the collected fibers, shown at 118, to pass through discharge opening 90 for supply to fiber collection tank 94. In addition, such movement of screen 86 causes the screen material to bend and flex, which provides the self-cleaning action as described above. The screen movement also varies the location at which the white water strikes the inside surfaces of screen 86, which again causes the screen material to locally bend and flex, to self-clean the screen.

As the usable fibers advance toward discharge opening 90, water and undesirable or unusable waste material contained within the white water continues to be separated from the fibers and discharged into waste water collection tank 96. Again, the waste water is routed to a waste water treatment facility for removal of undesirable material, and recirculation of the cleaned water into the system. The collected usable fibers in fiber collection tank 94 are again recirculated into the system through an outlet 120 associated with fiber collection tank 94.

Figure 13:
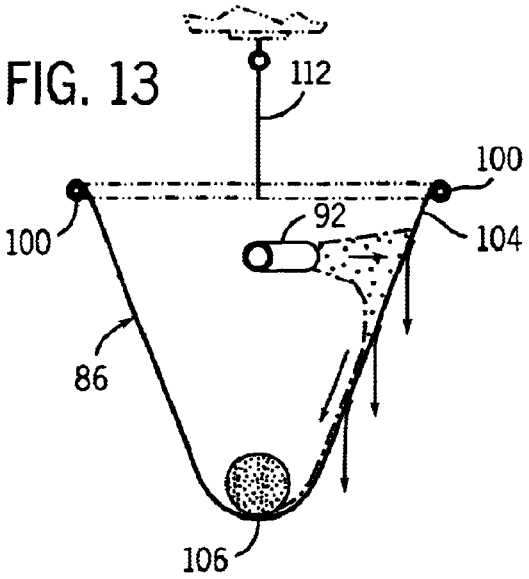
FIG. 13 is a section view taken along line 13—13 of FIG. 11, showing one embodiment for directing the white water onto the screen.
Figure 14:
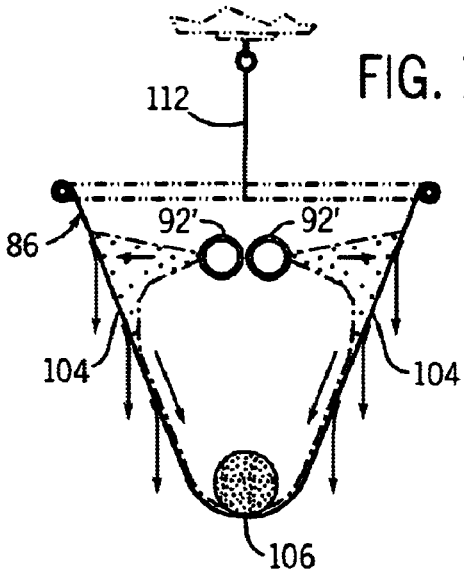
FIGS. 14–18 are views similar to FIG. 13, showing alternative embodiments for directing the white water onto the screen and for imparting motion to the screen.
Figure 15:
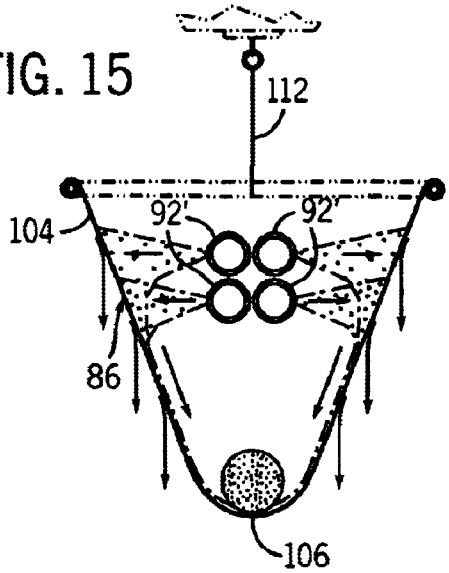

FIG. 13 illustrates a single conduit 92 arranged to direct white water onto a side wall 104 of screen 86. As shown in FIG. 14, it is also contemplated that a pair of conduits 92' may be arranged in a side-by-side manner, and spaced apart linear openings formed in the conduits 92' so as to direct a shower of white water onto the side walls 104 of screen 86. FIG. 15 illustrates the use of four white water supply conduits 92' for directing white water showers onto the side walls 104 of screen 86.

Figure 10:
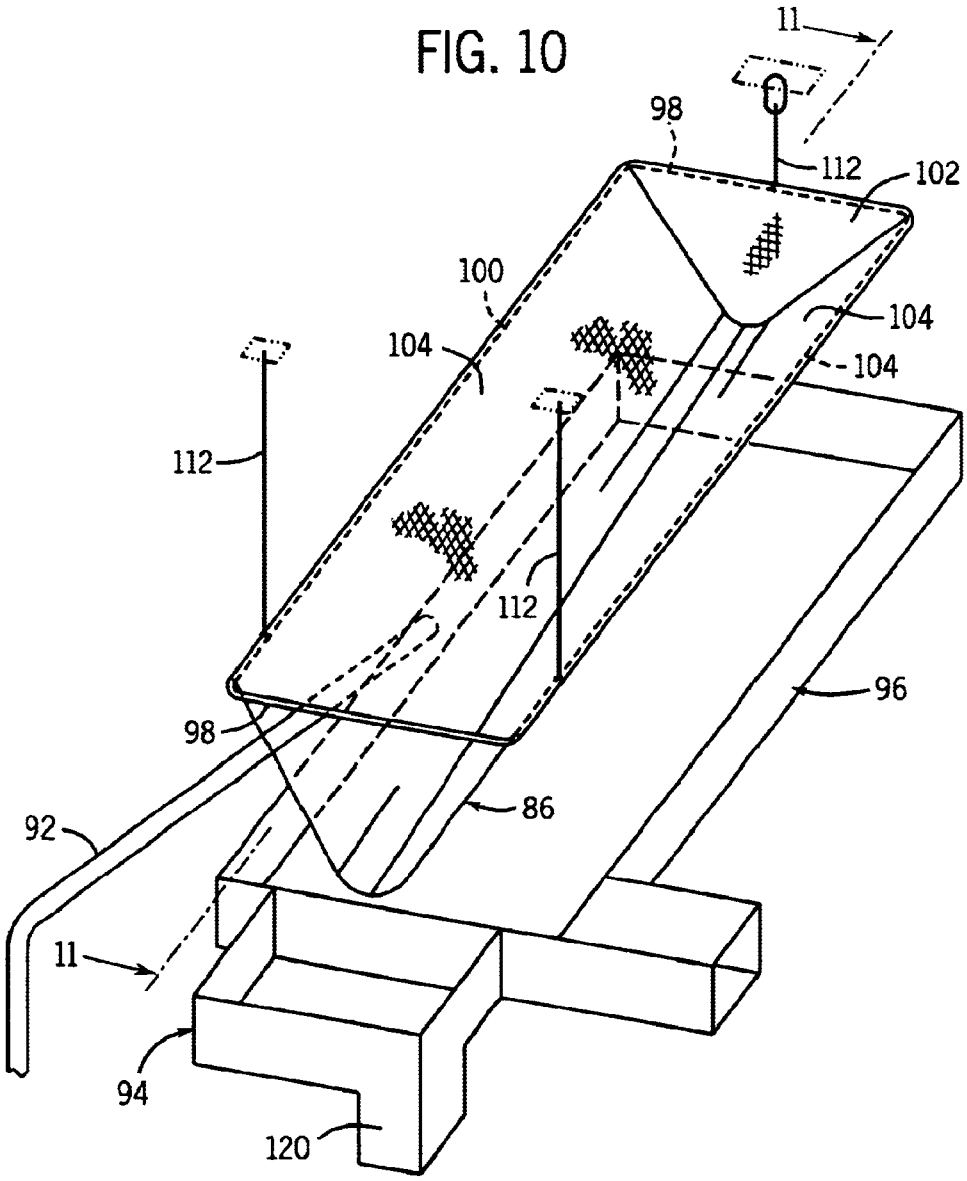
FIG. 10 is an isometric view illustrating another embodiment of a fiber recovery system in accordance with the present invention.
Figure 16:
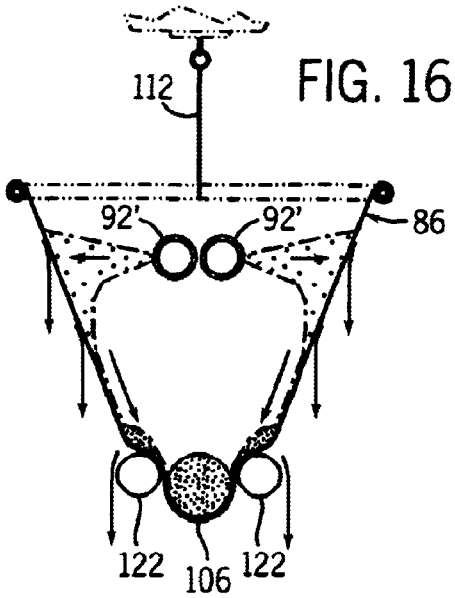

FIG. 16 illustrates an arrangement similar to FIG. 10, but incorporating a pair of bottom frame members 122 which assist in forming the collected fiber material in the bottom area of screen 86.

Figure 17:
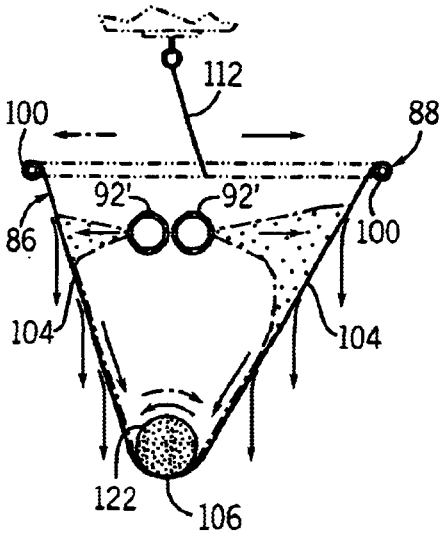

As shown in FIG. 17, it is also contemplated that screen 86 may be moved in a side-to-side manner to provide the same functions as set forth above. Again, this is accomplished by applying a lateral force to frame 88, either continuously or intermittently, to impart movement to screen 86. Such movement of screen 86 functions to roll the collected fibers in the bottom of the trough defined by screen 86, to form a fiber roll or log 122. The downward slope of screen bottom 106 functions to advance fiber roll or log 122 toward discharge outlet 90 as screen 86 is moved in a side-to-side manner.

Figure 18:
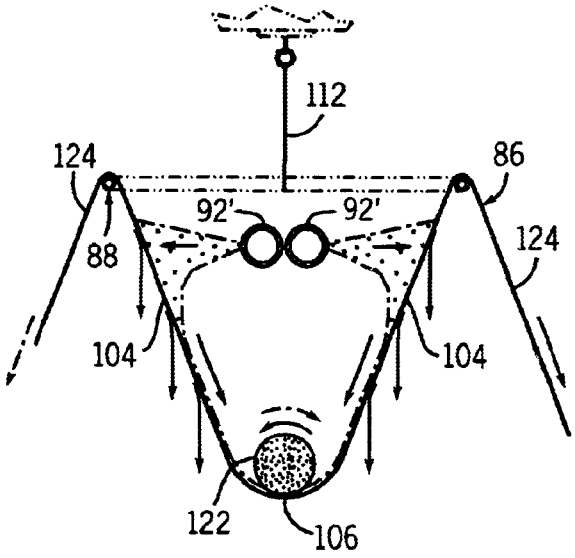

FIG. 18 illustrates another alternative arrangement, in which the side walls 104 of screen 86 are formed with extensions 124. The side wall extensions 124 are alternately extended and retracted, which results in the alternate lengthening and shortening of the screen side walls 104. In this manner, frame 88 twists about its longitudinal axis while screen 86 is moved to vary the location at which the white water strikes screen 86, to flex and self-clean screen 86, and to advance fiber roll or log 122 towards screen discharge outlet 90.

Figure 19:
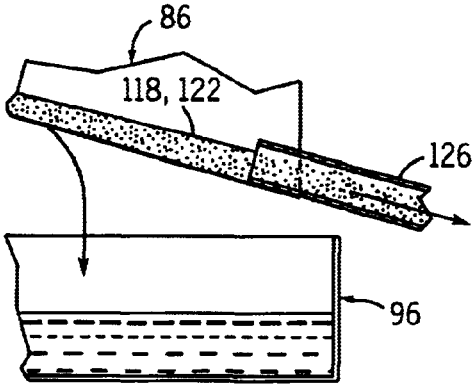
FIGS. 19 and 20 are partial side elevation views illustrating two different discharge arrangements for a screen configured as shown in FIG. 11.

FIG. 19 illustrates an arrangement in which a fiber discharge conduit 126 is located at the discharge outlet 90 of screen 86. The usable fibers advanced toward discharge outlet 90 are routed directly into the inlet of fiber discharge conduit 126, to eliminate the use of fiber collection tank 94 and to route the usable fibers directly back into the papermaking process.

Figure 20:
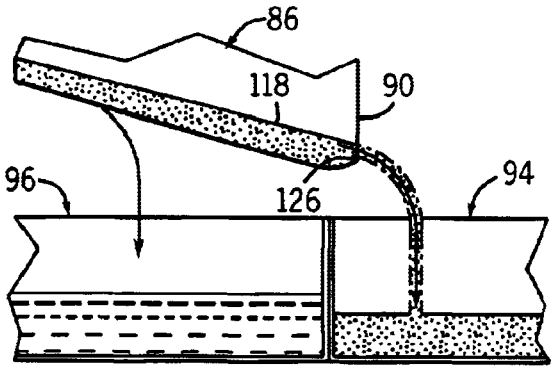

FIG. 20 illustrates the use of a rigid frame member 126 located at discharge outlet 90 of screen 86. This arrangement functions to create a fiber collection pocket at the bottom end of screen 86 adjacent discharge outlet 90, to form a dam over which the collected fiber material is discharged.

Figure 21:
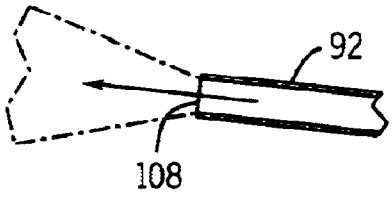
FIG. 21 is a view illustrating the discharge area of the supply conduit which directs the white water onto the screen in an embodiment such as illustrated in FIG. 10.
Figure 22:
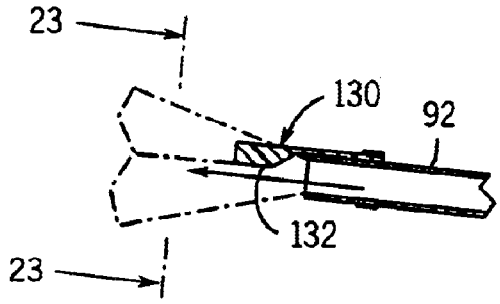
FIG. 22 is a view similar to FIG. 21, showing a flow deflector at the discharge of the supply conduit.
Figure 23:
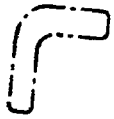
FIG. 23 is a section view taken along line 23—23 of FIG. 22.
Figure 24A:
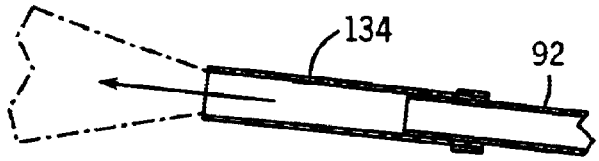
FIGS. 24A and 24B are views similar to FIG. 21, showing alternative arrangements at the discharge of the supply conduit for altering the path of the white water as it is directed toward the screen.
Figure 24B:
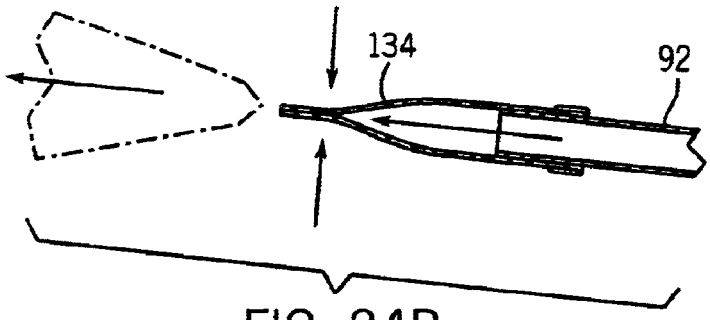

FIG. 21 shows white water supply conduit 92 having outlet 108 through which the stream of white water is discharged for application to the inside surfaces of screen 86. It is also contemplated that the location at which the white water impinges upon screen 86 can be varied by varying the location of the flow rather than varying the position of the screen. In this regard, as shown in FIG. 22, a flow deflector 130 may be mounted to conduit 92, having a fin 132 located in the white water flow path. Fin 132 is configured to move in response to the impingement of white water onto fin 132, to move the white water flow as it is directed toward screen 86. FIGS. 24A and 24B illustrate a flexible nozzle 134 mounted to the end of conduit 92. Nozzle 134 is formed of a flexible material such as rubber, and functions to move upwardly and downwardly in response to the emission of white water through its outlet so as to vary the location at which the white water impinges upon the inside surfaces of screen 86.

Figure 25:
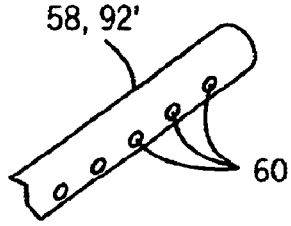
FIGS. 25–27 are views illustrating different opening configurations for a supply conduit, for use in directing the white water onto the screen.
Figure 26:
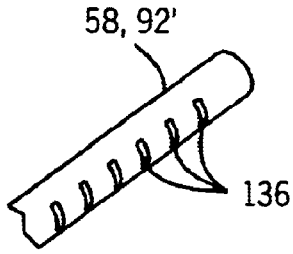
Figure 27:
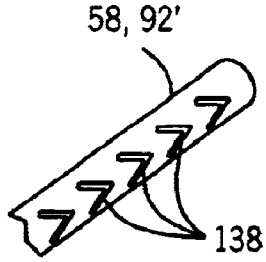

FIG. 25 illustrates white water supply conduits such as 58 or 92', having spaced openings 60 for providing a white water shower onto the inside surfaces of a screen, such as 32 or 86. Openings 60 are illustrated as being circular. As shown in FIG. 26, the openings may also be in the form of straight transverse slots 136, or, as shown in FIG. 27, in the form of V-shaped slots 138, to provide different shower configurations for applying the white water to the screen.

It is understood that additional variations and alternatives are possible for the system and details illustrated in FIGS. 11–27. For example, and without limitation, the particular shape and configuration of the screen may vary from the illustrated embodiment. Frame 88 may take any desired shape, and may be supported in any satisfactory manner. The white water may be applied to the screen using the various illustrated white water supply arrangements, or any other arrangement as desired. While the screen is shown and described as being movable either axially or transversely, it is understood that a combination of axial and transverse movement may also be employed.

Figure 28:
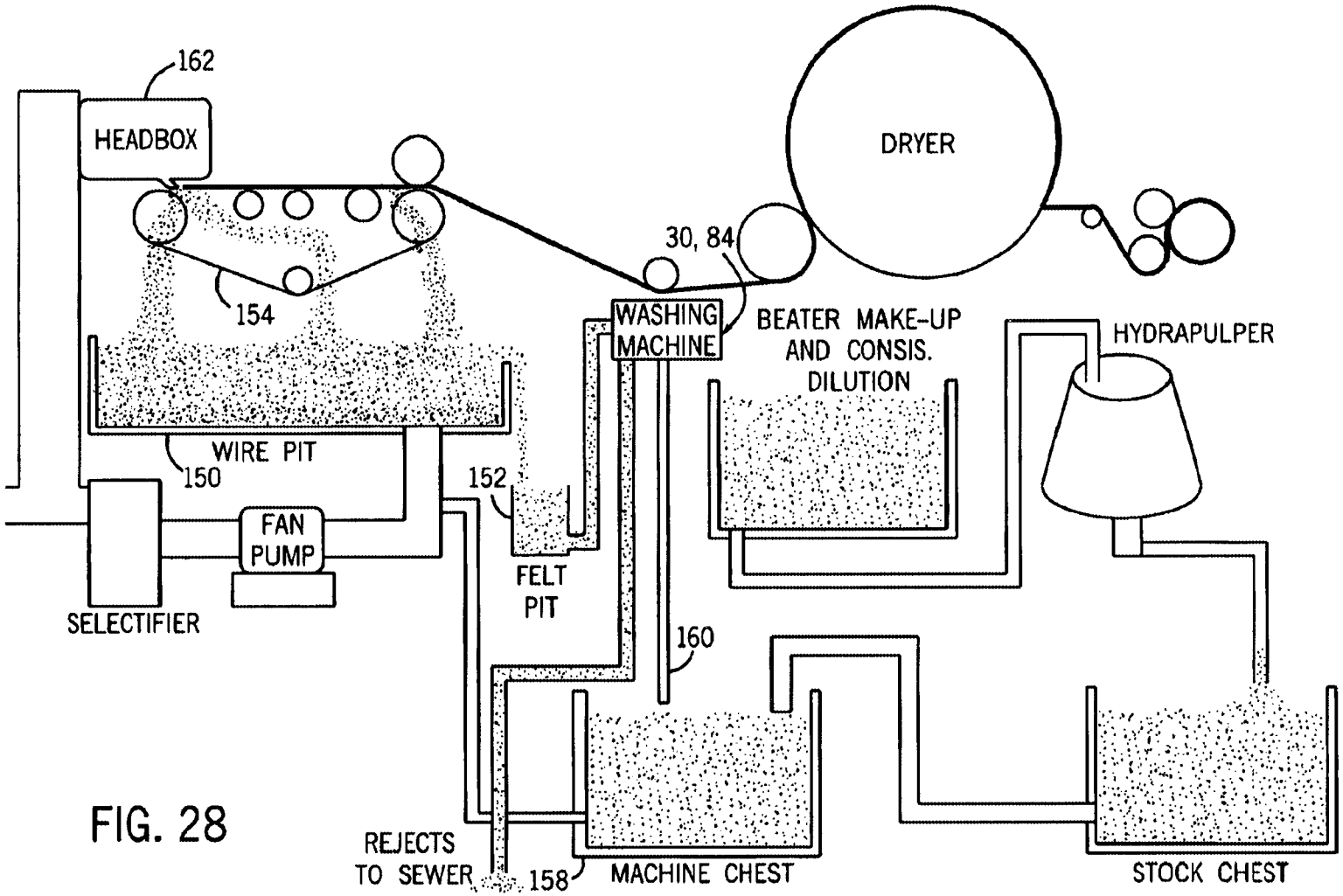
FIG. 28 is a schematic representation of a papermaking process incorporating the fiber recovery system of the present invention.

FIG. 28 illustrates a representative tissue or papermaking system in which the fiber recovery system of the present invention, shown at 30 and 84, may be incorporated. As shown, fiber recovery system 30, 84 is located downstream of the wire pit 150 and felt pit 152, which collects white water discharged through the fabric 154. The recovered fiber material is supplied to the machine chest 158 through an appropriate supply pipe 160, which supplies the recovered fibers into the supply stream for ultimate supply to the head box 162 of the tissue or papermaking machine. It is understood that any number of fiber recovery systems such as 30, 84 may be used according to the size of the tissue or papermaking system and the volume of white water produced in the system, to recover all of the usable fibers contained in the white water and to purge the system of small particulate material such as fines and ash.

Various alternatives and embodiments are contemplated as being within the scope of the following claims particularly pointing out and distinctly claiming the subject matter regarded as the invention.

I claim:

1. A fiber recovery system for use in a papermaking process for recovering usable fibers contained in papermaking white water, comprising:

a movable screen formed of a flexible and pliable screen material;

a white water supply arrangement for directing papermaking white water onto a surface of the screen at one or more impingement locations at which the white water strikes the surface of the screen, wherein the movability of the screen functions to vary the one or more impingement locations;

wherein the screen assumes an at-rest configuration when not in use and wherein, during operation of the fiber recovery system and movement of the screen, the flexibility and pliability of the material of the screen is operable to deform the screen outwardly relative to the at-rest configuration at the one or more impingement locations;

wherein the screen is sized so as to retain usable fibers contained in the white water on the surface of the screen and to allow water and small particles of waste material contained in the white water to pass through the screen;

a fiber collection and recovery arrangement for collecting usable fibers from a discharge area defined by the screen and for recirculating the usable fibers into the papermaking process;

wherein the flexible and movable screen is suspended from a frame arrangement; wherein the screen defines a conical configuration having an upper end connected to the frame arrangement and a lower end defining the discharge area; and wherein the frame arrangement is rotatable about a generally upright axis of rotation coincident with a longitudinal axis defined by the screen.

2. The fiber recovery system of claim 1, wherein the white water supply arrangement comprises a conduit arrangement located within an interior defined by the screen, wherein the conduit arrangement includes a series of openings through which white water is applied to the inside surface of the screen.

3. The fiber recovery system of claim 2, wherein the openings in the conduit arrangement are configured and arranged to apply a force to the inside surface of the screen tending to impart rotation to the screen about the axis of rotation of the frame arrangement.

4. A fiber recovery system for use in a papermaking process for recovering usable fibers contained in papermaking white water, comprising:

a flexible and movable screen;

a white water supply arrangement for directing papermaking white water onto a surface of the screen, wherein the flexibility and movability of the screen functions to vary the location at which the white water strikes the surface of the screen;

wherein the screen is sized so as to retain usable fibers contained in the white water on the surface of the screen and to allow water and small particles of waste material contained in the white water to pass through the screen;

a fiber collection and recovery arrangement for collecting usable fibers from a discharge area defined by the screen and for recirculating the usable fibers into the papermaking process;

wherein the screen is suspended from a frame arrangement and defines a conical configuration having an upper end connected to the frame arrangement and a lower end defining the discharge area; and wherein the frame arrangement is rotatable about a generally upright axis of rotation coincident with a longitudinal axis defined by the screen.

5. The fiber recovery system of claim 3, wherein the white water supply arrangement comprises a conduit arrangement located within an interior defined by the screen, wherein the conduit arrangement includes a series of openings through which white water is applied to the inside surface of the screen.

6. The fiber recovery system of claim 5, wherein the openings in the conduit arrangement are configured and arranged to apply a force to the inside surface of the screen tending to impart rotation to the screen about the axis of rotation of the frame arrangement.

7. A method of recovering usable fibers contained in papermaking white water, comprising the steps of:

directing the white water onto a surface of a screen at one or more impingement locations, wherein the screen is formed of a flexible and pliable material and defines openings sized to retain usable fibers on the surface of the screen and wherein the screen openings allow water and fine particles contained in the white water to pass through the screen, wherein the screen assumes an at-rest configuration when not in use; and causing movement of the screen while directing the white water onto the surface of the screen at the one or more impingement locations, wherein the movement of the screen is operable to vary the one or more impingement locations;

wherein the flexibility and pliability of the material of the screen is operable to deform the screen outwardly at the one or more impingement locations relative to the at-rest configuration of the screen to prevent build up of fine particles within the screen openings;

wherein the step of causing movement of the flexible screen is carried out by imparting movement to the screen through a frame arrangement from which the screen is suspended;

wherein the screen is configured to define a conical shape having an open lower end defining the discharge area of the screen and wherein the frame arrangement is located at an upper end defined by the screen, and wherein the step of directing the white water onto the surface of the screen is carried out by directing the white water outwardly toward an inner surface defined by the screen from a location within an interior defined by the screen; and wherein the step of imparting movement to the screen is carried out by rotating the frame while the white water is directed onto the inner surface of the screen.

8. The method of claim 7, further comprising the step of collecting the usable fibers from a discharge area defined by the screen, and recirculating the usable fibers into a papermaking process.

9. The method of claim 8, wherein the step of causing movement of the flexible screen is carried out by varying the location at which the papermaking white water is directed onto the surface of the screen.

10. The method of claim 7, wherein the step of imparting rotation to the screen is carried out by directing the white water tangentially against the inner surface of the screen.

11. A method of recovering usable fibers contained in papermaking white water, comprising the steps of:

directing the white water onto a surface of a flexible screen, wherein the screen defines openings sized to retain usable fibers on the surface of the screen and wherein the screen openings allow water and fine particles contained in the water to pass through the screen;

causing movement of the flexible screen while directing the white water onto the surface of the screen, wherein movement of the screen is operable to prevent build up of fine particles within the screen openings, wherein the step of causing movement of the flexible screen is carried out by imparting movement to the screen through a frame arrangement from which the screen is suspended; and collecting the usable fibers from a discharge area defined by the screen, and recirculating the usable fibers into a papermaking process;

wherein the screen is configured to define a conical shape having an open lower end defining the discharge area of the screen and wherein the frame arrangement is located at an upper end defined by the screen, and wherein the step of directing the white water onto the surface of the screen is carried out by directing the white water outwardly toward an inner surface defined by the screen from a location within an interior defined by the screen;

wherein the step of imparting movement to the screen is carried out by rotating the frame while the white water is directed onto the inner surface of the screen.

12. The method of claim 11, wherein the step of imparting rotation to the screen is carried out by directing the white water tangentially against the inner surface of the screen.

13. A fiber recovery system for use in recovering usable fibers contained in papermaking white water, comprising:

flexible screen means defining openings sized to prevent the passage of usable fibers therethrough, wherein the flexible screen means includes a generally conical upright screen member formed of a flexible and pliable screen material, wherein the screen member assumes an at-rest configuration when not in use, and wherein the flexible screen means defines a lower discharge area;

means for imparting movement to the screen member of the screen means by rotating the screen means about a generally upright axis of rotation;

white water supply means for directing white water onto the flexible screen member at one or more impingement locations;

wherein rotation of the screen member of the screen means is operable to vary the one or more impingement locations and wherein the flexibility and pliability of the screen material of the screen member is operable to deform the screen material of the screen member outwardly at the one or more impingement locations relative to the at-rest configuration of the screen member, to prevent the build up of fine particles contained in the white water within the openings of the screen member, and wherein the screen member functions to retain usable fibers on the surface of the screen member; and means for directing usable fibers on the surface of the screen member toward the discharge area of the screen member, to enable the usable fibers to be discharged from the screen means through the lower discharge area for recirculation into a papermaking process.

* * * * *

UNITED STATES PATENT AND TRADEMARK OFFICE

CERTIFICATE OF CORRECTION

PATENT NO. : 6,622,868 B1
DATED : September 23, 2003
INVENTOR(S) : Joseph P. McDonald It is certified that error appears in the above-identified patent and that said Letters Patent is hereby corrected as shown below:

Column 12,
Line 18, before "water" insert -- white --.

Signed and Sealed this

Sixth Day of January, 2004

JAMES E. ROGAN
*Director of the United States Patent and Trademark Office*